US007185969B2

(12) United States Patent
Mutz et al.

(10) Patent No.: US 7,185,969 B2
(45) Date of Patent: Mar. 6, 2007

(54) DROPLET DISPENSATION FROM A RESERVOIR WITH REDUCTION IN UNCONTROLLED ELECTROSTATIC CHARGE

(75) Inventors: Mitchell W. Mutz, Palo Alto, CA (US); David Soong-Hua Lee, Mountain View, CA (US); George McLendon, Princeton, NJ (US)

(73) Assignee: Labcyte Inc., Sunnyvale, CA (US)

( * ) Notice: Subject to any disclaimer, the term of this patent is extended or adjusted under 35 U.S.C. 154(b) by 0 days.

(21) Appl. No.: 11/481,341

(22) Filed: Jul. 3, 2006

(65) Prior Publication Data

US 2006/0244778 A1 Nov. 2, 2006

Related U.S. Application Data

(62) Division of application No. 10/340,557, filed on Jan. 9, 2003, now Pat. No. 7,070,260.

(51) Int. Cl.
*B41J 2/015* (2006.01)

(52) U.S. Cl. ..... 347/20; 347/55

(58) Field of Classification Search ..... 347/20, 347/44, 46, 47, 55, 56, 61–65, 67, 84–87
See application file for complete search history.

(56) References Cited

U.S. PATENT DOCUMENTS

| | | | | |
|---|---|---|---|---|
| 4,308,547 | A | 12/1981 | Lovelady et al. | 347/46 |
| 4,346,387 | A | 8/1982 | Hertz | 347/75 |
| 5,041,849 | A | 8/1991 | Quate et al. | 347/46 |
| 5,520,715 | A | 5/1996 | Oeftering | 15/335 |
| 5,635,968 | A | 6/1997 | Bhaskar et al. | 415/160 |
| 5,722,479 | A | 3/1998 | Oeftering | 164/46 |
| 5,798,779 | A | 8/1998 | Nakayasu et al. | 597/55 |
| 5,975,683 | A | 11/1999 | Smith et al. | 347/46 |
| 6,015,880 | A | 1/2000 | Baldeschwieler et al. | 347/55 |
| 6,079,814 | A | 6/2000 | Lean et al. | 347/345 |
| 6,367,909 | B1 | 4/2002 | Lean | 347/37 |
| 6,416,164 | B1 | 7/2002 | Stearns et al. | 347/46 |
| 6,454,955 | B1 | 9/2002 | Beerling et al. | 216/21 |
| 6,495,369 | B1 | 12/2002 | Kercso et al. | 436/47 |
| 6,596,239 | B2 | 7/2003 | Williams et al. | 422/100 |

(Continued)

FOREIGN PATENT DOCUMENTS

EP 0 729 262 A2 8/1996

(Continued)

OTHER PUBLICATIONS

U.S. Appl. No. 10/010,972, filed Dec. 4, 2001, Mutz et al.

(Continued)

*Primary Examiner*—Juanita D. Stephens
(74) *Attorney, Agent, or Firm*—Mintz, Levin, Cohn, Ferris, Glovsky and Popeo, P.C.

(57) ABSTRACT

Devices and methods are provided for reducing the uncontrolled electrostatic charges that can alter the volume and/or trajectory of a droplet, which is typically ejected through the application of focused acoustic radiation. Also provided are reservoirs and substrates, e.g., well plates formed from a material that is at least partially nonmetallic or polymeric and either has an electrical resistivity of no more than about $10^{11}$ ohm-cm, has a surface electrical resistivity of no more than about $10^{12}$ ohm/sq, or both.

10 Claims, 2 Drawing Sheets

U.S. PATENT DOCUMENTS

| | | | | |
|---|---|---|---|---|
| 6,789,965 | B2 * | 9/2004 | Barth et al. | 347/20 |
| 6,863,362 | B2 | 3/2005 | Reichel et al. | 347/16 |
| 6,925,865 | B2 | 8/2005 | Oku | 73/46 |
| 6,976,639 | B2 | 12/2005 | Williams et al. | 234/210 |
| 6,977,722 | B2 | 12/2005 | Wohlstadter et al. | 356/246 |
| 7,083,117 | B2 | 8/2006 | Williams et al. | 239/290 |
| 2002/0037375 | A1 | 3/2002 | Ellson et al. | 427/400 |
| 2002/0037579 | A1 | 3/2002 | Ellson et al. | 435/287.2 |
| 2002/0090720 | A1 | 7/2002 | Mutz et al. | 435/325 |
| 2002/0094582 | A1 | 7/2002 | Williams et al. | 436/100 |
| 2002/0109084 | A1 | 8/2002 | Ellson et al. | 250/288 |
| 2002/0125424 | A1 | 9/2002 | Ellson et al. | 250/288 |
| 2002/0140118 | A1 | 10/2002 | Lee | 264/4 |
| 2002/0142049 | A1 | 10/2002 | Lee | 424/449 |
| 2002/0155231 | A1 | 10/2002 | Ellson et al. | 427/400 |
| 2002/0196315 | A1 | 12/2002 | Isono et al. | 347/41 |
| 2003/0012892 | A1 | 1/2003 | Lee et al. | 427/400 |

FOREIGN PATENT DOCUMENTS

| | | |
|---|---|---|
| EP | 0 965 450 A1 | 12/1999 |
| EP | 1 080 897 A2 | 3/2001 |
| JP | 04201567 | 7/1992 |
| JP | 2000168191 | 6/2000 |

OTHER PUBLICATIONS

U.S. Appl. No. 10/175,374, filed Jun. 18, 2002, Ellson et al.
U.S. Appl. No. 10/199,907, filed Jul. 18, 2002, Mutz et al.
U.S. Appl. No. 10/310,638, filed Dec. 4, 2002, Mutz et al.
Amemiya et al. (1997), "Ink Jet Printing with Focused Ultrasonic Beams," *IS&T's NIP13: 1997 International Conference on Digital Printing Technologies*, pp. 698-702.

* cited by examiner

DROPLET DISPENSATION FROM A RESERVOIR WITH REDUCTION IN UNCONTROLLED ELECTROSTATIC CHARGE

CROSS-REFERENCE TO RELATED APPLICATIONS

This application is a divisional of U.S. patent application Ser. No. 10/340,557, filed Jan. 9, 2003 now U.S. Pat. No. 7,070,260, which is incorporated by reference herein.

TECHNICAL FIELD

This invention relates generally to devices and methods for accurately dispensing a droplet from a reservoir, optionally toward a substrate, wherein the volume and/or trajectory of the droplet do not substantially deviate from a predetermined volume and/or trajectory. More particularly, the invention relates to devices and methods for reducing the uncontrolled electrostatic charges that can alter the volume and/or trajectory of a droplet, which is typically ejected through the application of focused acoustic radiation.

BACKGROUND

There exists a need in pharmaceutical, biotechnological, medical, and other industries to be able to quickly screen, identify, analyze, and/or process large numbers or varieties of fluids. As a result, much attention has been focused on developing efficient, precise, and accurate fluid handling methods. For example, automated robotic systems have been used in combination with precise registration technologies to dispense reagents through automated pick-and-place ("suck-and-spit") fluid handling systems. Similarly, some efforts have been directed to adapting printing technologies, particularly inkjet printing technologies, to form biomolecular arrays. For example, U.S. Pat. No. 6,015,880 to Baldeschwieler et al. is directed to array preparation using multistep in situ synthesis. Such synthesis may involve using inkjet technology to dispense reagent-containing droplets to a locus on a surface chemically prepared to permit covalent attachment of the reagent.

Such conventional fluid handling systems, however, exhibit certain inherent disadvantages. For example, most fluid handling systems presently in use require that contact be established between the fluid to be transferred and an associated solid surface on the transferring device. Such contact typically results in surface wetting that causes unavoidable fluid waste, a notable drawback when the fluid to be transferred is rare and/or expensive. When fluid dispensing systems are constructed using networks of tubing or other fluid transporting conduits, air bubbles can be entrapped or particulates may become lodged in the networks. Nozzles of ordinary inkjet printheads are also subject to clogging, especially when used to eject a macromolecule-containing fluid at elevated temperatures, a situation commonly associated with such technologies. As a result, ordinary fluid dispensing technologies are prone to produce improperly sized or misdirected droplets.

A number of patents have described the use of focused acoustic radiation to dispense fluids such as inks and reagents. For example, U.S. Pat. No. 4,308,547 to Lovelady et al. describes a liquid drop emitter that utilizes acoustic principles to eject droplets from a body of liquid onto a moving document to result in the formation of characters or barcodes thereon. A nozzleless inkjet printing apparatus is used such that controlled drops of ink are propelled by an acoustical force produced by a curved transducer at or below the surface of the ink. Similarly, U.S. Patent Application Publication No. 20020037579 to Ellson et al. describes a device for acoustically ejecting a plurality of fluid droplets toward discrete sites on a substrate surface for deposition thereon. U.S. Patent Application Publication No. 20020094582 to Williams describes technologies that employ focused acoustic technology as well. In contrast to inkjet printing devices, focused acoustic radiation may be used to effect nozzleless fluid ejection, and devices using focused acoustic radiation are not generally subject to clogging and the disadvantages associated therewith, e.g., misdirected fluid or improperly sized droplets.

Since fluids used in pharmaceutical, biotechnological, and other scientific industries may be rare and/or expensive, techniques capable of handling small volumes of fluids provide readily apparent advantages over those requiring relatively larger volumes. Typically, fluids for use in combinatorial methods are provided as a collection or library of organic and/or biological compounds. In many instances, well plates are used to store a large number of fluids for screening and/or processing. Well plates are typically of single piece construction and comprise a plurality of identical wells, wherein each well is adapted to contain a small volume of fluid. Such well plates are commercially available in standardized sizes and may contain, for example, 96, 384, 1536, or 3456 wells per well plate.

The ideal fluid-dispensing technique for pharmaceutical, biotechnological, medical (including clinical testing), and other industries provides for highly repeatable and accurate ejection of minute volumes of fluids directly from wells of a well plate. When used to prepare biomolecular arrays, the dispensing technique provides for deposition of droplets on a substrate surface, wherein droplet volume—and thus "spot" size on the substrate surface—can be carefully controlled. In order to ensure accurate placement of the droplets on a substrate surface, the droplets must take an appropriate trajectory from the wells of well plates.

The use of electric fields is well known in the printing arts to control the trajectory of ink droplets in a predetermined trajectory. For example, U.S. Pat. No. 5,975,683 to Smith et al. describes a method and an apparatus that employ electrostatic acceleration to compensate for environmental factors that cause misdirection of ink droplets from an inkjet printhead. In addition, U.S. Pat. No. 4,346,387 to Hertz describes a method and an apparatus for controlling the electrostatic charge on liquid droplets formed from a liquid stream emerging from a nozzle of an inkjet printhead.

Similarly, the use of electric fields is known in conjunction with focused acoustic radiation. For example, U.S. Pat. Nos. 5,520,715 and 5,722,479, each to Oeftering, describe an apparatus for manufacturing a freestanding solid metal part through acoustic ejection of charged molten metal droplets. The apparatus employs electric fields to direct the charged droplets to predetermined points on a target where the droplets solidify as a result of cooling. Similarly, U.S. Patent Application Publication Nos. 20020109084 and 20020125424, each to Ellson et al., describe the use of focused acoustic radiation to introduce droplets of fluids into ionization chambers such as those associated with mass spectrometers. Moreover, U.S. Pat. Nos. 6,079,814 and 6,367,909, each to Lean et al., describe printing methods and apparatuses that employ electric fields to reduce drop placement errors. Typically, an aperture plate is used to charge a free surface of a fluid in a reservoir. Then, focused acoustic radiation is applied to a point near the fluid surface so as to eject a charged droplet therefrom and through the aperture of the plate. Additional electric fields may be employed to direct the charged droplet so that it follows a predetermined trajectory. Optionally, an electric field may also serve to tack a recording medium in position to receive the ink droplet.

Although it is sometimes a straightforward matter to use electric fields to control the size and trajectory of droplet ejected from a single reservoir, it is quite difficult to achieve such control in high-throughput applications. For example, when acoustic ejection is employed to transfer fluids from a 96-well source plate to a 384-well target plate, the relative motion between the plates makes it difficult to maintain the presence of a consistent charge within each well over time. In addition, it has been discovered that wells of commercially available well plates, particularly those made from plastic materials such as polypropylene, polystyrene, or cyclic olefins, are often prone to accumulate uncontrolled electrostatic charge. Uncontrolled electrostatic charge tends to alter the volume and/or trajectory of droplets dispensed from well plates. This alteration in droplet volume and/or trajectory particularly pronounced for devices constructed to dispense droplets at a relatively low velocity.

Thus, there is a need to reduce the accumulation of uncontrolled electrostatic charge associated with droplet-dispensing devices, in order to control the volume and/or trajectory of a droplet dispensed from a reservoir of such a device. Since droplets ejected using focused acoustic radiation tends to exhibit a lower velocity than droplets ejected from ordinary inkjet technologies such as thermal ejection, the need is particularly great for ejection devices that use focused acoustic radiation.

SUMMARY OF THE INVENTION

Accordingly, it is an object of the present invention to provide devices and methods that overcome the above-mentioned disadvantages of the prior art. In one embodiment, the invention provides a device comprised of a reservoir adapted to contain a fluid and a dispenser for dispensing a fluid droplet from the reservoir. A means is employed for reducing uncontrolled electrostatic charge on the reservoir when the reservoir is prone to accumulate uncontrolled electrostatic charge that alters the volume and/or trajectory of a droplet dispensed therefrom. The means for reducing uncontrolled electrostatic charge is effective to ensure that the volume and/or trajectory of the dispensed droplet do not substantially deviate from a predetermined volume and/or predetermined trajectory. Often grounding is used to reduce or eliminate uncontrolled electrostatic charge.

In another embodiment, the invention provides a similar device that further comprises a substrate positioned to receive the dispensed droplet. When the substrate is prone to accumulate uncontrolled electrostatic charge that alters the volume and/or trajectory of the dispensed droplet, a means for reducing uncontrolled electrostatic charge is provided that is effective to ensure that the volume and/or trajectory of the dispensed droplet do not substantially deviate from a predetermined volume and/or predetermined trajectory.

Typically, the dispenser is comprised of an acoustic ejector. In some instances, the acoustic ejector may comprise an acoustic radiation generator for generating acoustic radiation and a focusing means for focusing the acoustic radiation generated. In such cases, the invention also provides a means for positioning the ejector in acoustic coupling relationship to the reservoir. Typically, the reservoir, the substrate, and any other component of the device prone to accumulate uncontrolled electrostatic charge have an electrical resistivity of no more than about $10^{11}$ ohm-cm, have a surface electrical resistivity of no more than about $10^{12}$ ohm/sq, or both. This may be achieved by using a material that is at least partially nonmetallic or polymeric.

In a further embodiment, the invention provides a method for dispensing a droplet from a reservoir containing a fluid. The method involves reducing uncontrolled electrostatic charge on the reservoir when the reservoir is prone to accumulate uncontrolled electrostatic charge that alters the volume and/or trajectory of a droplet dispensed therefrom. As a result, uncontrolled electrostatic charge is reduced to a level effective to ensure that the volume and/or trajectory of the dispensed droplet do not substantially deviate from a predetermined volume and/or predetermined trajectory.

In yet another embodiment, the invention provides a method for dispensing a droplet from a reservoir containing a fluid onto a substrate. The method involves reducing uncontrolled electrostatic charge on the reservoir and/or the substrate when the reservoir and/or substrate are prone to accumulate uncontrolled electrostatic charge that alters the volume and/or trajectory of the dispensed droplet. Uncontrolled electrostatic charge is reduced to a level effective to ensure that the volume and/or trajectory of the dispensed droplet do not substantially deviate from a predetermined volume and/or predetermined trajectory.

For any of the inventive methods, focused acoustic radiation may be applied in a manner effective to eject a droplet of fluid from the reservoir.

BRIEF DESCRIPTION OF THE DRAWINGS

The invention is described in detail below with reference to the following drawings, wherein like reference numerals indicate a corresponding structure throughout the several views.

FIG. 1A shows the acoustic ejector acoustically coupled to a first reservoir and having been activated in order to eject a first droplet of fluid from within the reservoir toward a particular site on a substrate surface. FIG. 1B shows the acoustic ejector acoustically coupled to a second reservoir and having been activated to eject a second droplet of fluid from within the second reservoir.

DETAILED DESCRIPTION OF THE INVENTION

Figure 1A:
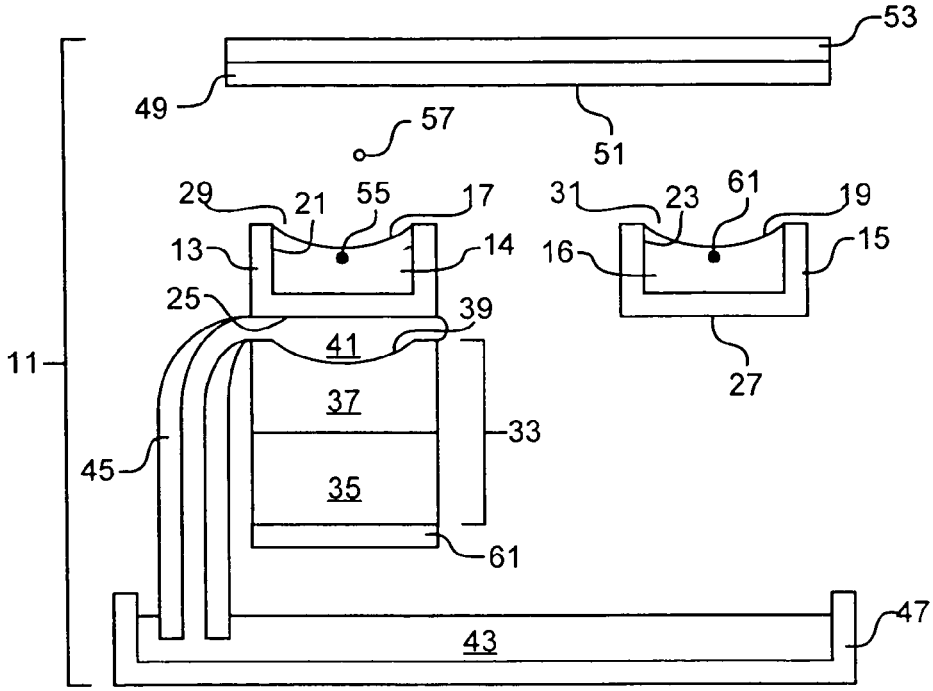
FIGS. 1A and 1B, collectively referred to as FIG. 1, schematically illustrate in simplified cross-sectional view the operation of a focused acoustic ejection device in the preparation of a plurality of features on a substrate surface.

Definitions and Overview:

Before describing the present invention in detail, it is to be understood that this invention is not limited to specific fluids, biomolecules, or device structures, as such may vary. It is also to be understood that the terminology used herein is for the purpose of describing particular embodiments only, and is not intended to be limiting.

It must be noted that, as used in this specification and the appended claims, the singular forms "a," "an," and "the" include both singular and plural referents unless the context clearly dictates otherwise. Thus, for example, reference to "a reservoir" includes a plurality of reservoirs as well as a single reservoir, reference to "a droplet" includes a plurality of droplets as well as single droplet, and the like.

In describing and claiming the present invention, the following terminology will be used in accordance with the definitions set out below.

The terms "acoustic coupling" and "acoustically coupled" as used herein refer to a state wherein an object is placed in direct or indirect contact with another object so as to allow acoustic radiation to be transferred between the objects without substantial loss of acoustic energy. When two items are indirectly acoustically coupled, an "acoustic coupling medium" is needed to provide an intermediary through which acoustic radiation may be transmitted. Thus, an ejector may be acoustically coupled to a fluid, e.g., by immersing the ejector in the fluid or by interposing an acoustic coupling medium between the ejector and the fluid, in order to transfer acoustic radiation generated by the ejector through the acoustic coupling medium and into the fluid.

The term "array" as used herein refers to a two-dimensional arrangement of features, such as an arrangement of reservoirs (e.g., wells in a well plate) or an arrangement of different moieties, including ionic, metallic, or covalent crystalline, e.g., molecular crystalline, composite, ceramic, vitreous, amorphous, fluidic, or molecular materials on a substrate surface (as in an oligonucleotide or peptidic array). Arrays are generally comprised of regular features that are ordered, as in, for example, a rectilinear grid, parallel stripes, spirals, and the like, but non-ordered arrays may be advantageously used as well. In particular, the term "rectilinear array" as used herein refers to an array that has rows and columns of features wherein the rows and columns typically, but not necessarily, intersect each other at a ninety-degree angle. An array is distinguished from the more general term "pattern" in that patterns do not necessarily contain regular and ordered features. Arrays typically but do not necessarily comprise at least about 4 to about 10,000,000 features, generally in the range of about 4 to about 1,000,000 features.

The terms "biomolecule" and "biological molecule" are used interchangeably herein to refer to any organic molecule that is, was, or can be a part of a living organism, regardless of whether the molecule is naturally occurring, recombinantly produced, or chemically synthesized in whole or in part. The terms encompass, for example, nucleotides, amino acids, and monosaccharides, as well as oligomeric and polymeric species, such as oligonucleotides and polynucleotides; peptidic molecules, such as oligopeptides, polypeptides, and proteins; saccharides, such as disaccharides, oligosaccharides, polysaccharides, and mucopolysaccharides or peptidoglycans (peptido-polysaccharides); and the like. The terms also encompass ribosomes, enzyme cofactors, pharmacologically active agents, and the like. Additional information relating to the term "biomolecule" can be found in U.S. Patent Application Publication No. 20020037579 to Ellson et al.

The term "capillary" is used herein to refer to a conduit having a bore of small dimension. Typically, capillaries for electrophoresis that are free standing tubes have an inner diameter in the range of about 50 to about 250 μm. Capillaries with extremely small bores integrated to other devices, such as openings for loading microchannels of microfluidic devices, can be as small as 1 μm, but in general these capillary openings are in the range of about 10 to about 100 μm. In the context of delivery to a mass analyzer in electrospray-type mass spectrometry, the inner diameter of capillaries may range from about 0.1 to about 3 mm and preferably from about 0.5 to about 1 mm. In some instances, a capillary can represent a portion of a microfluidic device. In such instances, the capillary may be an integral or affixed (permanently or detachably) portion of the microfluidic device.

The term "fluid" as used herein refers to matter that is nonsolid, or at least partially gaseous and/or liquid, but not entirely gaseous. A fluid may contain a solid that is minimally, partially, or fully solvated, dispersed, or suspended. Examples of fluids include, without limitation, aqueous liquids (including water per se and salt water) and nonaqueous liquids such as organic solvents and the like. As used herein, the term "fluid" is not synonymous with the term "ink" in that an ink must contain a colorant and may not be gaseous.

The terms "focusing means" and "acoustic focusing means" refer to a means for causing acoustic waves to converge at a focal point, either by a device separate from the acoustic energy source that acts like an optical lens, or by the spatial arrangement of acoustic energy sources to effect convergence of acoustic energy at a focal point by constructive and destructive interference. A focusing means may be as simple as a solid member having a curved surface, or it may include complex structures such as those found in Fresnel lenses, which employ diffraction in order to direct acoustic radiation. Suitable focusing means also include phased array methods as are known in the art and described, for example, in U.S. Pat. No. 5,798,779 to Nakayasu et al. and by Amemiya et al. (1997) *Proceedings of the* 1997 *IS&T* NIP13 *International Conference on Digital Printing Technologies*, pp. 698–702. Additional information regarding acoustic focusing is provided in U.S. patent application Ser. No. 10/066,546, entitled "Acoustic Sample Introduction for Analysis and/or Processing," filed Jan. 30, 2002, inventors Ellson and Mutz.

The terms "library" and "combinatorial library" are used interchangeably herein to refer to a plurality of chemical or biological moieties arranged in a pattern or an array such that the moieties are individually addressable. In some instances, the plurality of chemical or biological moieties is present on the surface of a substrate, and in other instances the plurality of moieties represents the contents of a plurality of reservoirs. Preferably, but not necessarily, each moiety is different from each of the other moieties. The moieties may be, for example, peptidic molecules and/or oligonucleotides.

The "limiting dimension" of an opening refers herein to the theoretical maximum diameter of a sphere that can pass through an opening without deformation. For example, the limiting dimension of a circular opening is the diameter of the opening. As another example, the limiting dimension of a rectangular opening is the length of the shorter side of the rectangular opening. The opening may be present on any solid body including, but not limited to, sample vessels, substrates, capillaries, microfluidic devices, and ionization chambers. Depending on the purpose of the opening, the opening may represent an inlet and/or an outlet.

The term "moiety" refers to any particular composition of matter, e.g., a molecular fragment, an intact molecule (including a monomeric molecule, an oligomeric molecule, or a polymer), or a mixture of materials (for example, an alloy or a laminate).

The term "near," as used herein, refers to the distance from the focal point of the focused acoustic radiation to the surface of the fluid from which a droplet is to be ejected, and indicates that the distance should be such that the focused acoustic radiation directed into the fluid results in droplet ejection from the fluid surface; one of ordinary skill in the art will be able to select an appropriate distance for any given fluid using straightforward and routine experimentation. Generally, however, a suitable distance between the focal point of the acoustic radiation and the fluid surface is in the range of about 1 to about 15 times the wavelength of the speed of sound in the fluid, more typically in the range of about 1 to about 10 times that wavelength, preferably in the range of about 1 to about 5 times that wavelength.

"Optional" or "optionally" means that the subsequently described circumstance may or may not occur, so that the description includes instances where the circumstance occurs and instances where it does not.

The term "radiation" is used in its ordinary sense and refers to emission and propagation of energy in the form of a waveform disturbance traveling through a medium such any permanent displacement of the medium itself. Thus, radiation may refer, for example, to electromagnetic waveforms as well as acoustic vibrations.

Accordingly, the terms "acoustic radiation" and "acoustic energy" are used interchangeably herein and refer to the emission and propagation of energy in the form of sound waves. As with other waveforms, acoustic radiation may be focused using a focusing means, as discussed below. Although acoustic radiation may have a single frequency and associated wavelength, acoustic radiation may take a form, e.g. a "linear chirp," that includes a plurality of frequencies. Thus, the term "characteristic wavelength" is used to describe the mean wavelength of acoustic radiation having a plurality of frequencies.

The term "reservoir" as used herein refers to a receptacle or chamber for containing a fluid. In some instances, a fluid contained in a reservoir necessarily will have a free surface, e.g., a surface that allows acoustic radiation to be reflected therefrom or a surface from which a droplet may be acoustically ejected. A reservoir may also be a locus on a substrate surface within which a fluid is constrained.

The term "substrate" as used herein refers to any material having a surface onto which one or more fluids may be deposited. The substrate may be constructed in any of a number of forms including, for example, wafers, slides, well plates, or membranes. In addition, the substrate may be porous or nonporous as required for deposition of a particular fluid. Suitable substrate materials include, but are not limited to, supports that are typically used for solid phase chemical synthesis, such as polymeric materials (e.g., polystyrene, polyvinyl acetate, polyvinyl chloride, polyvinyl pyrrolidone, polyacrylonitrile, polyacrylamide, polymethyl methacrylate, polytetrafluoroethylene, polyethylene, polypropylene, polyvinylidene fluoride, polycarbonate, and divinylbenzene styrene-based polymers), agarose (e.g., Sepharose®), dextran (e.g., Sephadex®), cellulosic polymers and other polysaccharides, silica and silica-based materials, glass (particularly controlled pore glass, or "CPG") and functionalized glasses, ceramics, and such substrates treated with surface coatings, e.g., with microporous polymers (particularly cellulosic polymers such as nitrocellulose), microporous metallic compounds (particularly microporous aluminum), antibody-binding proteins (available from Pierce Chemical Co., Rockford Ill.), bisphenol A polycarbonate, or the like. Additional information relating to the term "substrate" can be found in U.S. Patent Application Publication No. 200200377579 to Ellson et al.

The term "substantially" as in, for example, the phrase "substantially deviate from a predetermined volume," refers to a volume that does not deviate by more than about 25%, preferably 10%, more preferably 5%, and most preferably at most 2%, from the predetermined volume. Other uses of the term "substantially" involve an analogous definition.

The term "sample vessel" as used herein refers to any hollow or concave receptacle having a structure that allows for sample processing and/or analysis. Thus, a sample vessel has an inlet opening through which sample may be introduced and an optional, but preferred, outlet opening through which processed or analyzed sample may exit.

In general, the invention relates to devices and methods for dispensing a fluid droplet of a predetermined volume and/or predetermined trajectory from a reservoir adapted to contain a fluid. The invention derives from the observation that fluid dispensing devices or components thereof sometimes accumulate uncontrolled electrostatic charge such that droplets dispensed therefrom exhibit a volume and/or trajectory that substantially deviate from the predetermined volume and/or predetermined trajectory. This is particularly problematic when the device is adapted to dispense droplets containing a minute volume of fluid. Often, the reservoir itself is prone to accumulate such uncontrolled electrostatic charge. Thus, the invention provides for the reduction of such uncontrolled electrostatic charge in a manner effective to ensure that the volume and/or trajectory of the dispensed droplet conform to the predetermined volume and/or trajectory. In particular, the invention is particularly suited for applications that require the efficient transport and/or deposition of small quantities of fluid.

Among the various routes for an item to accumulate electrostatic charge is the triboelectric effect, by which an item will typically accumulate uncontrolled electrostatic charge through friction, pressure, and separation. The magnitude of the static charge is typically determined by material composition, applied forces, separation rate, and dissipative forces. Generally, the ability of a material to surrender or gain electrons is a function of the conductivity of the material. The tendency of a material to accumulate uncontrolled electrostatic charge is inversely correlated to the surface and/or volume conductivity of the material. Accordingly, the invention is particularly suited for use in devices comprised of components that exhibit a low electrical conductivity or high electrical resistivity. Typically, the invention will be useful to reduce uncontrolled electrostatic charge in items having a volume electrical resistivity of at least $10^{13}$ ohm-cm and/or a surface electrical resistivity of at least $10^{14}$ ohm/sq. As the usefulness of the invention increases with the electrical resistance of the item requiring reduction in controlled electrostatic charge, one skilled in the art will recognize that the invention will be particularly useful to discharge items having a volume electrical resistivity of at least $10^{15}$ or $10^{16}$ ohm-cm and/or a surface electrical resistivity of at least $10^{16}$ or $10^{17}$ ohm/sq.

The invention may be employed with any type of fluid dispenser that serves to dispense one or more droplets of fluid from a reservoir. Any fluid droplet dispensing techniques known in the art may be used in conjunction with the present invention. For example, the invention may be used with dispensers such as inkjet printheads (both thermal and piezoelectric), pipettes, capillaries, syringes, displacement pumps, rotary pumps, peristaltic pumps, vacuum devices, flexible or rigid tubing, valves, manifolds, pressurized gas canisters, and combinations thereof. While nonacoustic techniques may be used to dispense fluid from the reservoir, the invention is particularly suited for use with nozzleless acoustic ejection techniques that employ focused acoustic radiation generated by acoustic ejectors, such as those described in U.S. Patent Application Publication No. 20020037579 to Ellson et al. This publication sets forth that an ejector may be acoustically coupled to a reservoir containing a fluid in order to eject a droplet therefrom. In some instances, the reservoir may be a well of a well plate. Since this device configuration allows droplets to be ejected from near the base of a well, uncontrolled electrostatic charge anywhere in the well, e.g., the base or sidewalls, may have a strong effect influence on the volume and/or trajectory of such droplets. Since conventional inkjet systems do exhibit such a configuration, the invention more typically used with devices that employ focused acoustic radiation rather than ordinary inkjet technologies.

Since acoustic ejection provides a number of advantages over other fluid dispensing technologies, one embodiment of the invention provides a device for acoustically ejecting a droplet of fluid from a reservoir. The device is comprised of a reservoir adapted to contain a fluid, an ejector for ejecting a droplet from the reservoir, and a means for positioning the ejector in acoustic coupling relationship to the reservoir. The ejector comprises an acoustic radiation generator for generating acoustic radiation and a focusing means for focusing the acoustic radiation generated by the generator. As described in U.S. Patent Application Publication No. 20020037579 to Ellson et al., the acoustic radiation is focused at a focal point within and sufficiently near the fluid surface in the reservoir to result in the ejection of droplets therefrom. Furthermore, a means is provided for reducing any uncontrolled electrostatic charge on the device or a portion thereof that alters the volume and/or trajectory of a droplet ejected from the reservoir. As a result, the volume and/or trajectory of the ejected droplet do not substantially deviate from a predetermined volume and/or predetermined trajectory.

The device may be constructed to include the reservoir as an integrated or permanently attached component of the device. However, to provide modularity and interchangeability of components, it is preferred that the device be constructed with a removable reservoir. Optionally, a plurality of reservoirs many be provided. Generally, the reservoirs are arranged in a pattern or an array to provide each reservoir with individual systematic addressability. In addition, while each of the reservoirs may be provided as a discrete or stand-alone item, in circumstances that require a large number of reservoirs, it is preferred that the reservoirs be attached to each other or represent integrated portions of a single reservoir unit. For example, the reservoirs may represent individual wells in a well plate.

Many well plates suitable for use with the device are commercially available and may contain, for example, 96, 384, 1536, or 3456 wells per well plate, having a full skirt, half skirt, or no skirt. The wells of such well plates typically form rectilinear arrays. Manufacturers of suitable well plates for use in the employed device include Corning, Inc. (Corning, N.Y.) and Greiner America, Inc. (Lake Mary, Fla.). However, the availability of such commercially available well plates does not preclude the manufacture and use of custom-made well plates containing at least about 10,000 wells, or as many as 100,000 to 500,000 wells, or more. The wells of such custom-made well plates may form rectilinear or other types of arrays. As well plates have become commonly used laboratory items, the Society for Biomolecular Screening (Danbury, Conn.) has formed the Microplate Standards Development Committee to recommend and maintain standards to facilitate the automated processing of small volume well plates on behalf of and for acceptance by the American National Standards Institute.

Furthermore, the material used in the construction of reservoirs must be compatible with the fluids contained therein. Thus, if it is intended that the reservoirs or wells contain an organic solvent such as acetonitrile, polymers that dissolve or swell in acetonitrile would be unsuitable for use in forming the reservoirs or well plates. Similarly, reservoirs or wells intended to contain DMSO must be compatible with DMSO. For water-based fluids, a number of materials are suitable for the construction of reservoirs and include, but are not limited to, ceramics such as silicon oxide and aluminum oxide, metals such as stainless steel and platinum, and polymers such as polyester and polytetrafluoroethylene. For fluids that are photosensitive, the reservoirs may be constructed from an optically opaque material that has sufficient acoustic transparency for substantially unimpaired functioning of the device. Thus, the reservoir may be adapted to contain any type of fluid, metallic or nonmetallic, organic or inorganic.

It should be noted that from a manufacturing perspective, polymeric materials are particularly suited for use in forming reservoirs for use with the invention, e.g., well plates that conform to industrial standards. Such materials typically exhibit the appropriate mechanical, acoustical, and chemical properties suited for use with the invention. For example, well plates may be formed from polymeric material selected from the group consisting of polyethylenes, polypropylenes, polybutylenes, polystyrenes, cyclic olefins, combinations thereof, and copolymers of any of the foregoing. Such polymers are generally inert to aqueous solutions and can be easily formed through casting, injection molding, extrusion, and other well-established processing techniques. However, such polymers are noted for their high volume and surface resistivity, e.g., at least $10^{13}$ ohm-cm and at least $10^{14}$ ohm/sq, respectively. Thus, the invention also relates to reservoirs and well plates that exhibit a resistivity wherein the reservoir, the optional substrate, or both are comprised of a material that is at least partially polymeric and either has an electrical resistivity of no more than about $10^{11}$ ohm-cm, has a surface electrical resistivity of no more than about $10^{12}$ ohm/sq, or both.

While most polymeric materials are insulators, conductive polymers are known in the art. For example, polythiophenes are a well-known class of conductive polymer and generally exhibit greater chemical stability than polyacetylene derivatives. Conductive polymer materials are extremely economical to produce and have been used commercially in the semiconductor field as containers for electrostatically sensitive materials. Relatively stable polythiophene derivatives include polyisothianapthene (PITN) and poly-3,4,ethylene dioxythiophene (PEDT), and a variety of related materials such as doped polypropylenes, are commercially available from RTP Company, Winona, Minn.

In some instances, an electrically conductive layer may be used to increase the conductivity of a reservoir. Such a layer may be provided as a surface coating or incorporated within a reservoir to increase the reservoir's conductivity. For example, any part of an ordinary plastic well plate comprising an array of 96 substantially identical wells prone to accumulate uncontrolled electrostatic charge may be coated a metallic coating. For example, metals such as aluminum, gold, silver, copper, platinum, palladium, or nickel may be selectively deposited on the upper, lower, interior, and/or exterior surface of an ordinary commercially available well plate. Similarly, plating technologies may be used to increase the thickness of the metallic coating. Furthermore, nonmetallic coatings may be used as well. For example, known conductive ceramic coating materials include indium tin oxide and titanium nitride. In addition, various forms of carbon, e.g., carbon fibers, graphite, or acetylene black, may be applied as a surface coating on the reservoir.

In addition, or in the alternative, a polymeric reservoir may contain an electrically conductive filler. Any of the materials suitable for forming the electrically conductive layer as discussed above may be used as a filler material. For example, carbon-filled plastics are well known in the art for electrostatic dissipation. Such carbon-filled plastics may be obtained from Minnesota Mining & Manufacturing Company Corporation (St. Paul, Minn.) under the trademark Velostat®. Such reservoirs may be formed using ordinary polymer processing techniques.

When a plurality of reservoirs is employed, the acoustic radiation generator may have to be aligned with each reservoir during operation, discussed infra. In order to reduce the amount of movement and time needed to align the generator successively with each reservoir, it is preferable that the center of each reservoir be located not more than about 1 centimeter, more preferably not more than about 1.5 millimeters, still more preferably not more than about 1 millimeter and optimally not more than about 0.5 millimeter, from a neighboring reservoir center. These dimensions tend to limit the size of the reservoirs to a maximum volume. The reservoirs are constructed to contain typically no more than about 1 mL, preferably no more than about 100 μL, more preferably no more than about 10 μL, still more preferably no more than about 1 μL, and optimally no more than about 1 nL, of fluid. The reservoirs may be either completely or partially filled with fluid. For example, fluid may occupy a volume of about 10 pL to about 100 nL.

When an array of reservoirs is provided, each reservoir may be individually, efficiently, and systematically addressed. Although any type of array may be employed, arrays comprised of parallel rows of evenly spaced reservoirs are preferred. Typically, though not necessarily, each row contains the same number of reservoirs. Optimally, rectilinear arrays comprising X rows and Y columns of reservoirs are employed with the invention, wherein X and Y are each at least 2. In some instances, X may be greater than, equal to, or less than Y. In addition, nonrectilinear arrays as well as other geometries may be employed. For example, hexagonal, spiral, or other types of arrays may be used. In some instances, the invention may be employed with irregular patterns of reservoirs, e.g., droplets randomly located on a flat substrate surface such as those associated with a CD-ROM format. In addition, the invention may be used with reservoirs associated with microfluidic devices.

Moreover, the invention may be used to dispense fluids of virtually any type and amount desired. The fluid may be aqueous and/or nonaqueous. Examples of fluids include, but are not limited to, aqueous fluids including water per se and water-solvated ionic and non-ionic solutions; organic solvents; lipidic liquids; suspensions of immiscible fluids; and suspensions or slurries of solids in liquids. Because the invention is readily adapted for use with high temperatures, fluids such as liquid metals, ceramic materials, and glasses may be used, as described in U.S. Patent Application Publication No. 20020140118. In some instances, the reservoir may contain a biomolecule, nucleotidic, peptidic, or otherwise. In addition, the invention may be used in conjunction with dispensers for dispensing droplets of immiscible fluids, as described in U.S. Patent Application Publication Nos. 2002037375 and 20020155231, or to dispense droplets containing pharmaceutical agents, as discussed in U.S. Patent Application Publication No. 20020142049 and U.S. patent application Ser. No. 10/244,128, entitled "Precipitation of Solid Particles from Droplets Formed Using Focused Acoustic Energy," filed, Sep. 13, 2002, inventors Lee, Ellson and Williams.

Any of a variety of focusing means may be employed to focus acoustic radiation so as to eject droplets from a reservoir. For example, one or more curved surfaces may be used to direct acoustic radiation to a focal point near a fluid surface. One such technique is described in U.S. Pat. No. 4,308,547 to Lovelady et al. Focusing means with a curved surface have been incorporated into the construction of commercially available acoustic transducers such as those manufactured by Panametrics Inc. (Waltham, Mass.). In addition, Fresnel lenses are known in the art for directing acoustic energy at a predetermined focal distance from an object plane. See, e.g., U.S. Pat. No. 5,041,849 to Quate et al. Fresnel lenses may have a radial phase profile that diffracts a substantial portion of acoustic energy into a predetermined diffraction order at diffraction angles that vary radially with respect to the lens. The diffraction angles should be selected to focus the acoustic energy within the diffraction order on a desired object plane. It should be noted that acoustic focusing means exhibiting a variety of F-numbers may be employed with the invention. As discussed in U.S. Pat. No. 6,416,164 to Stearns et al., however, low F-number focusing places restrictions on the reservoir and fluid level geometry and provides relatively limited depth of focus, increasing the sensitivity to the fluid level in the reservoir. Thus, the focusing means suitable for use with the invention typically exhibits an F-number of at least about 1. Preferably, the focusing means exhibits an F-number of at least about 2.

There are a number of ways to acoustically couple the ejector to a reservoir and thus to the fluid therein. One such approach is through direct contact, as is described, for example, in U.S. Pat. No. 4,308,547 to Lovelady et al., wherein a focusing means constructed from a hemispherical crystal having segmented electrodes is submerged in a liquid to be ejected. The aforementioned patent further discloses that the focusing means may be positioned at or below the surface of the liquid. However, this approach for acoustically coupling the focusing means to a fluid is undesirable when the ejector is used to eject different fluids in a plurality of containers or reservoirs, as repeated cleaning of the focusing means would be required in order to avoid cross-contamination. The cleaning process would necessarily lengthen the transition time between each droplet ejection event. In addition, in such a method, fluid would adhere to the ejector as it is removed from each container, wasting material that may be costly or rare.

Thus, a preferred approach is to acoustically couple the ejector to the reservoir without contacting any portion of the ejector, e.g., the focusing means, with the fluids to be ejected. When a plurality of reservoirs is employed, a positioning means is provided for positioning the ejector in controlled and repeatable acoustic coupling with each of the fluids in the reservoirs to eject droplets therefrom without submerging the ejector therein. This typically involves direct or indirect contact between the ejector and the external surface of each reservoir. When direct contact is used in order to acoustically couple the ejector to each reservoir, it is preferred that the direct contact be wholly conformal to ensure efficient acoustic energy transfer. That is, the ejector and the reservoir should have corresponding surfaces adapted for mating contact. Thus, if acoustic coupling is achieved between the ejector and reservoir through the focusing means, it is desirable for the reservoir to have an outside surface that corresponds to the surface profile of the focusing means. Without conformal contact, efficiency and accuracy of acoustic energy transfer may be compromised. In addition, since many focusing means have a curved surface, the direct contact approach may necessitate the use of reservoirs having a specially formed inverse surface.

When an ejector is placed in indirect contact with a reservoir, an acoustic coupling medium may be interposed between the reservoir and ejector. Typically, the acoustic coupling medium is a fluid. In addition, the acoustic coupling medium is preferably an acoustically homogeneous material that is substantially free of material having different acoustic properties than the fluid medium itself. Furthermore, it is preferred that the acoustic coupling medium be comprised of a material having acoustic properties that facilitate the transmission of acoustic radiation without significant attenuation in acoustic pressure and intensity. Also, the acoustic impedance of the coupling medium should facilitate the transfer of energy from the coupling medium into the reservoir. An aqueous fluid, such as water per se, may be employed as an acoustic coupling medium. Ionic additives, e.g., salts, may sometimes be added to the coupling medium to increase the conductivity of the coupling medium.

A single ejector is preferred, although the inventive device may include a plurality of ejectors. When a single ejector is employed, the means for positioning the ejector may be adapted to provide relative motion between the ejector and reservoirs. The positioning means should allow for the ejector to move from one reservoir to another quickly and in a controlled manner, thereby allowing fast and controlled scanning of the reservoirs to effect droplet ejection therefrom. Thus, various means for positioning the ejector in acoustic coupling relationship to the reservoir are generally known in the art and may involve, e.g., devices that provide movement having one, two, three, four, five, six, or more degrees of freedom. Accordingly, when rows of reservoirs are provided, relative motion between the acoustic radiation generator and the reservoirs may result in displacement of the acoustic radiation generator in a direction along the rows. Similarly, when a rectilinear array of reservoirs is provided, the ejector may be movable in a row-wise direction and/or in a direction perpendicular to both the rows and columns.

In addition, the rate at which fluid droplets can be delivered is related to the efficiency of fluid delivery.

Current positioning technology allows for the ejector positioning means to move from one reservoir to another quickly and in a controlled manner, thereby allowing fast and controlled ejection of different fluid samples. That is, current commercially available technology allows the ejector to be moved from one reservoir to another, with repeatable and controlled acoustic coupling at each reservoir, in less than about 0.1 second for high performance positioning means and in less than about 1 second for ordinary positioning means. A custom designed system will allow the ejector to be moved from one reservoir to another with repeatable and controlled acoustic coupling in less than about 0.001 second.

The invention also enables rapid ejection of droplets from one or more reservoirs, e.g., at a rate of at least about 1,000,000 droplets per minute from the same reservoir, and at a rate of at least about 100,000 drops per minute from different reservoirs, assuming that the droplet size does not exceed about 10 μm in diameter. One of ordinary skill in the art will recognize that the droplet generation rate is a function of drop size, viscosity, surface tension, and other fluid properties. In general, the droplet generation rate increases with decreasing droplet diameter, and 1,000,000 droplets per minute is achievable for most aqueous fluid drops under about 10 μm in diameter.

The invention may be used in any context where precise placement of a fluid droplet is desirable or necessary. In particular, the invention may be employed to improve accuracy and precision associated with nozzleless acoustic ejection. For example, it is described in U.S. Patent Application Publication No. 20020037579 to Ellson et al. that acoustic ejection technology may be used to form biomolecular arrays. Similarly, acoustic ejection technology may be employed to format a plurality of fluids, e.g., to transfer fluids from odd-sized bulk containers to wells of a standardized well plate or to transfer fluids from one well plate to another. Furthermore, as described in U.S. Patent Application Publication Nos. 20020109084 and 20020125424, each to Ellson et al., focused acoustic radiation may serve to eject a droplet of fluid from a reservoir into any sample vessel for processing and/or analyzing a sample molecule, e.g., into a sample introduction interface of a mass spectrometer, an inlet opening that provides access to the interior region of a capillary, or an inlet port of a microfluidic device. Similarly, the invention may be used to eject droplets of analysis-enhancing fluid on a sample surface in order to prepare the sample for analysis, e.g., for MALDI or SELDI-type analysis.

As discussed above, uncontrolled electrostatic charge may be accumulated by a substrate onto which droplets are dispensed. Such charge may also have a detrimental influence on the trajectory and/or volume of the dispensed droplets. Thus, construction considerations for such substrates are similar to those associated with reservoirs, as discussed above. For example, the substrate may exhibit a relatively high electrical conductivity for ease in grounding. Similarly, the materials and techniques suitable for use in forming the reservoir may also be used with the substrate. In some instances, a single means for reducing uncontrolled charge may be used for both the reservoir and substrate.

In order to prepare an array on a substrate surface, the substrate must be placed in droplet-receiving relationship to a reservoir. Thus, the invention may also employ a positioning means for positioning the substrate. With respect to the substrate positioning means and the ejector positioning means, it is important to keep in mind that there are two basic kinds of motion: pulse and continuous. For the ejector positioning means, pulse motion involves the discrete steps of moving an ejector into position, emitting acoustic energy, and moving the ejector to the next position; again, using a high performance positioning means with such a method allows repeatable and controlled acoustic coupling at each reservoir in less than 0.1 second. A continuous motion design, on the other hand, moves the ejector and the reservoirs continuously, although not necessarily at the same speed, and provides for ejection during movement. Since the pulse width is very short, this type of process enables over 10 Hz reservoir transitions, and even over 1000 Hz reservoir transitions. Similar engineering considerations are applicable to the substrate positioning means.

From the above, it is evident that the relative positions and spatial orientations of the various components may be altered depending on the particular desired task at hand. In such a case, the various components of the device may require individual control or synchronization to direct droplets onto designated sites on a substrate surface. For example, the ejector positioning means may be adapted to eject droplets from each reservoir in a predetermined sequence associated with an array of designated sites on the substrate surface. Any positioning means of the present invention may be constructed from, e.g., levers, pulleys, gears, a combination thereof, or other mechanical means known to one of ordinary skill in the art.

A means for reducing uncontrolled electrostatic charge is employed so that any dispensed droplet exhibits a volume and/or trajectory that conform to a predetermined volume and/or trajectory. In general, the means for reducing uncontrolled electrostatic charge is selected according to the location, amount, and type of static electricity to be eliminated. Thus, for example, if a reservoir is prone to accumulate such uncontrolled electrostatic charge, the means for reducing uncontrolled electrostatic charge must be constructed according to the construction of the reservoir. Similarly, if a substrate onto which a droplet may be directed is susceptible to the accumulation of uncontrolled electrostatic charge, the means for reducing electrostatic charge may be constructed accordingly.

Typically, any effort to eliminate uncontrolled electrostatic charge may ensure that a droplet dispensed from the reservoir has a volume that does not deviate from the predetermined volume by more than about 10%. Preferably, the droplet volume does not deviate from the predetermined volume by more than about 5%. Optimally, the volume does not deviate from the predetermined volume by more than about 2%. In addition, the trajectory of the droplet dispensed from the reservoir will typically not deviate from the predetermined trajectory by more than about 5°. Preferably, the trajectory does not deviate from the predetermined trajectory by more than about 10. Optimally, the trajectory does not deviate from the predetermined trajectory by more than about 0.50.

A number of electrostatic control techniques are known in the art and are suited for use with the present invention. Such techniques typically involve either addition or removal of electrons from the item that has accumulated uncontrolled electrostatic charge. On occasion, though, positive ions may be added or removed from the item. In general, electrostatic charge can be removed through grounding, induction, ionization, or a combination thereof. Such electrostatic charge neutralization may be effected immediately before or during the dispensation of a droplet.

Typically, uncontrolled electrostatic charge may be eliminated from an item through grounding, i.e., connecting the item via a conductor to an effectively infinite source of charge. Grounding is particularly suited for instances in which electrostatic charge is located in an ungrounded but highly conductive item. In such a case, the entire item may be neutralized when it is connected to ground at a single point. For example, items constructed from a material having a volume electrical resistivity of no more than about $10^4$ ohm-cm and/or a surface electrical resistivity of no more than about $10^5$ ohm/sq may be used. Preferably, the electrical resistivity is no more than about $10^3$ ohm-cm and/or the surface electrical resistivity is no more than about $10^4$ ohm/sq. For items comprised of a single material of high electrical resistivity, e.g., nonconductive polymers and ceramics, however, neutralization of the entire item may require the establishment of more than a single-point contact. In some instances, neutralization of an item may be achieved by providing the item with intermittent or sustained contact with an electrically conductive solid material.

Removing or neutralizing electrostatic charge by induction is a time-tested method suitable for use with any nonconductive material, insulated material, or ungrounded conductive material. Induction requires the use of an electrically conductive induction member that operates in a manner similar to the operation of a lightning rod. Typically, a grounded induction member, such as tinsel or a brush, is placed in close proximity, e.g., about 0.5 cm to about 1.0 cm, to the surface of the material to be neutralized. If the electrostatic charge on the material reaches or exceeds a threshold level, e.g., at least several thousand volts, the energy concentrated on the ends of the induction member will induce ionization. When the electrostatic charge is negative in polarity, positive ions from the grounded member will be attracted by the static laden surface. Conversely, if the static charge is positive in polarity, negative ions from the grounded member will be attracted back to the charged area.

It should be noted, however, that since a threshold voltage is required to "start" the process, induction may not reduce or neutralize static electricity to the ground potential level. In addition, an ungrounded induction member will remove charge for a short period of time only. Eventually the induction member will self charge and stop working when the electric field between the ends and the charged surface is reduced to a level that cannot support ionization. Thus, passive static control devices relying solely on induction tend to leave a residual charge.

Ionization techniques typically involve the production of both positive and negative ions to be attracted by the material to be neutralized. This may be achieved by generating an alternating electric field between a sharp point in close proximity to a grounded shield or casing. As the extremes of potential difference are reached, the air between the sharp point and the grounded casing is broken down. As a result, positive and negative ions are generated. In other words, half of the cycle is utilized to generate negative ions and the other half is utilized to generate positive ions. When a 60 Hz unit is employed, the polarity of ionization is changed every 1/120 of a second. If the material to be neutralized is positively charged, it will immediately absorb negative ions and repel the positive ions into space. Conversely, if the material to be neutralized is negatively charged, it will absorb the positive ions and repel the negative ions. When the material becomes neutralized, there is no longer electrostatic attraction and the material will cease to absorb ions.

Other equipment may also be used to generate ionized air for electrostatic neutralization. Nuclear-powered ionizers are known in the art. For example, Polonium 210 isotopes may be used to generate ions. Since Polonium has a half-life of only 138 days, such ionizers continually lose their strength and must be replaced annually. Similarly, electromagnetic radiation sources may be used to eliminate electrostatic charge. In some instances, such electromagnetic sources employ an ultraviolet radiation generator.

In some instances, surface conductivity of an item may be increased through the use of use of additives such anti-static sprays. An ordinary anti-static spray is comprised of a surfactant diluted in a solvent. A fire retardant may be added to counter the flammability of the solvent. Once applied to the surface of the item, the fire retardant and solvents evaporate, leaving a conductive coating on the surface of the material. The plastic has now become conductive and as long as this coating is not disturbed, it will be difficult to generate static electricity in this material. Thus, it should be evident that neutralization of an item may involve establishing intermittent or prolonged contacting of the item with a liquid and/or electrostatic-charge-reducing fluid. For example, when a fluid acoustic coupling medium is employed through which the ejector is acoustically coupled to the reservoir, the acoustic coupling medium may be comprised of an electrostatic-charge-reducing fluid.

Thus, it should be apparent that one of ordinary skill in the art may adapt any of the above-described or known equipment and techniques for reducing uncontrolled electrostatic charge for use with the present invention. It is also noted that use of a means for reducing uncontrolled electrostatic charge does not exclude the controlled use of ionization technology for directing droplet trajectory. Such technologies are generally well known in the art and are described, for example, in U.S. Patent Application Publication Nos. 20020109084 and 20020125424, each to Ellson et al. Because uncontrolled electrostatic charging may occur with the use of ionization technology to direct droplet trajectories, the invention may also be used to ensure that dispensed droplets conform to a predetermined size and/or predetermined trajectory.

However, it is generally preferred that all electric fields are eliminated with the practice of the invention. Thus, the invention preferably involves dispensing one or more droplets in the absence of any electrostatic charge or electric field that alters the trajectory and/or size of dispensed droplets. For example, in high-throughput and array applications, it is desirable to have control over the direction, volume, and velocity of dispensed droplets onto a droplet-receiving surface. Sometimes, production of a droplet of appropriate direction, volume, and velocity is accompanied by the production of a secondary or satellite droplet that should not be deposited onto the droplet-receiving surface. Using an electric field may accelerate both drops onto a receiving surface. In addition, electric fields may adversely interfere with droplet formation so as to result in difficulty in controlling droplet size.

FIG. 1 illustrates an exemplary focused acoustic ejection device suitable for use with the invention, in simplified cross-sectional view. As with all figures referenced herein, in which like parts are referenced by like numerals, FIG. 1 is not to scale, and certain dimensions may be exaggerated for clarity of presentation. The device 11 includes a plurality of reservoirs, i.e., at least two reservoirs—a first reservoir indicated at 13 and a second reservoir indicated at 15. Each reservoir contains a combination of two or more immiscible fluids, and the individual fluids as well as the fluid combinations in the different reservoirs may be the same or different. As shown, reservoir 13 contains fluid 14, and reservoir 15 contains fluid 16. Fluids 14 and 16 have fluid surfaces respectively indicated at 17 and 19. As shown, the reservoirs are of substantially identical construction so as to be substantially acoustically indistinguishable, but identical construction is not a requirement. The reservoirs are shown as separate removable components but may, if desired, be fixed within a plate or other substrate. Each of the reservoirs 13 and 15 is axially symmetric as shown, having vertical walls 21 and 23 extending upward from circular reservoir bases 25 and 27 and terminating at openings 29 and 31, respectively, although other reservoir shapes may be used. The material and thickness of each reservoir base should be such that acoustic radiation may be transmitted therethrough and into the fluid contained within the reservoirs.

The device also includes an acoustic ejector 33 comprised of an acoustic radiation generator 35 for generating acoustic radiation, and a focusing means 37 for focusing the acoustic radiation at a focal point near the fluid surface from which a droplet is to be ejected, wherein the focal point is selected so as to result in droplet ejection. The focal point may be in the upper fluid layer or the lower fluid layer, but is preferably just below the interface therebetween. As shown in FIG. 1, the focusing means 37 may comprise a single solid piece having a concave surface 39 for focusing acoustic radiation, but the focusing means may be constructed in other ways as discussed below. The acoustic ejector 33 is thus adapted to generate and focus acoustic radiation so as to eject a droplet of fluid from each of the fluid surfaces 17 and 19 when acoustically coupled to reservoirs 13 and 15, respectively. The acoustic radiation generator 35 and the focusing means 37 may function as a single unit controlled by a single controller, or they may be independently controlled, depending on the desired performance of the device. Typically, single ejector designs are preferred over multiple ejector designs, because accuracy of droplet placement, as well as consistency in droplet size and velocity, are more easily achieved with a single ejector.

Optimally, acoustic coupling is achieved between the ejector and each of the reservoirs through indirect contact. In FIG. 1A, an acoustic coupling medium 41 is placed between the ejector 33 and the base 25 of reservoir 13, with the ejector and reservoir located at a predetermined distance from each other. The acoustic coupling medium 41 is introduced from a coupling medium source 43 via dispenser 45. Also as depicted in FIG. 1, an optional collector 47 is employed to collect coupling medium that may drip from the lower surface of either reservoir. As the collector 47 is depicted as containing the coupling medium source 43, it is evident that the coupling medium may be reused. Other means for introducing and/or placing the coupling medium may be employed as well. By using an electrically conductive fluid as the acoustic coupling medium, the coupling medium source 43 and dispenser 45 serve as a means for reducing uncontrolled electrostatic charge from the reservoirs.

In operation, each reservoir 13 and 15 of the device is filled with different fluids, as explained above. The acoustic ejector 33 is positionable by means of ejector positioning means 43, shown below reservoir 13, in order to achieve acoustic coupling between the ejector and the reservoir through acoustic coupling medium 41. If droplet ejection onto a substrate is desired, a substrate 49 may be positioned above and in proximity to the first reservoir 13 such that one surface of the substrate, shown in FIG. 1 as underside surface 51, faces the reservoir and is substantially parallel to the surface 17 of the fluid 14 therein. The substrate 49 is held by substrate positioning means 53, which, as shown, is grounded. Thus, when the substrate 49 is comprised of a conductive material, the substrate 49 is grounded as well. Once the ejector, the reservoir, and the substrate are in proper alignment, the acoustic radiation generator 35 is activated to produce acoustic radiation that is directed by the focusing means 37 to a focal point 55 near the fluid surface 17 of the first reservoir. As a result, droplet 57 is ejected from the fluid surface 17, optionally onto a particular site (typically although not necessarily, a pre-selected, or "predetermined" site) on the underside surface 49 of the substrate. The ejected droplet may be retained on the substrate surface by solidifying thereon after contact; in such an embodiment, it is necessary to maintain the substrate surface at a low temperature, i.e., at a temperature that results in droplet solidification after contact. Alternatively, or in addition, a molecular moiety within the droplet attaches to the substrate surface after contact, through adsorption, physical immobilization, or covalent binding.

Figure 1B:
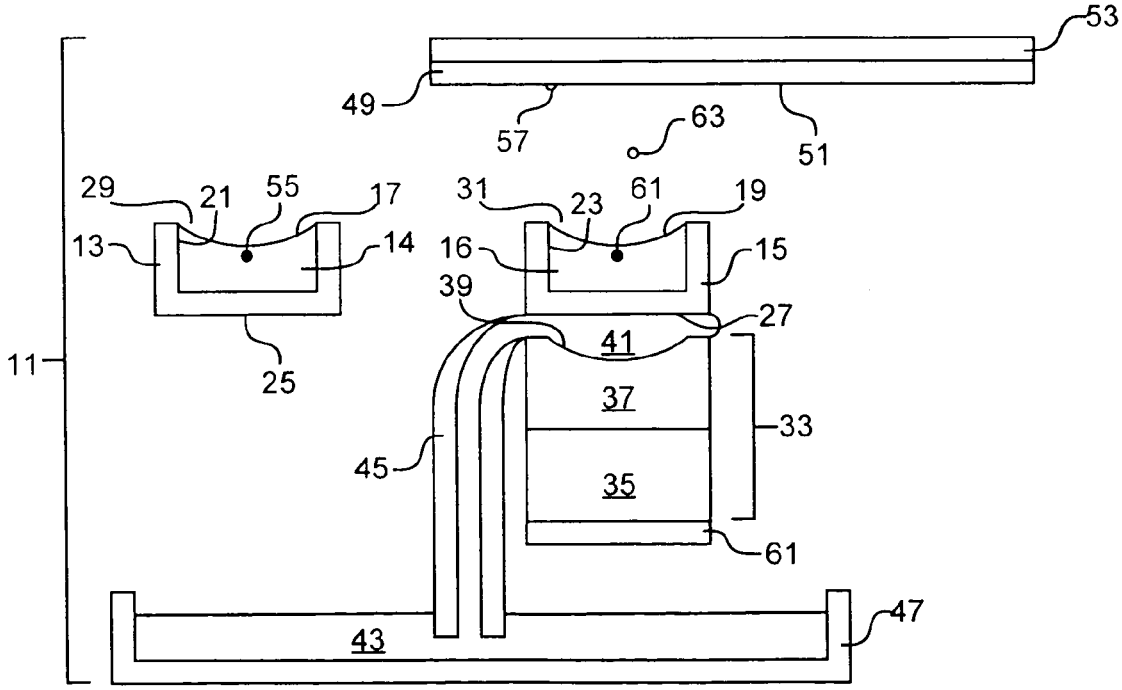

Then, as shown in FIG. 1B, a substrate positioning means 53 may be used to reposition the substrate 49 (if used) over reservoir 15 in order to receive a droplet therefrom at a second site. FIG. 1B also shows that the ejector 33 has been repositioned by the ejector positioning means 59 below reservoir 15 and in acoustically coupled relationship thereto by virtue of acoustic coupling medium 41. Once properly aligned, as shown in FIG. 1B, the acoustic radiation generator 35 of ejector 33 is activated to produce acoustic radiation that is then directed by focusing means 37 to a focal point within the reservoir fluids in reservoir 15, thereby ejecting droplet 63, optionally onto the substrate.

It should be evident that such operation is illustrative of how the inventive device may be used to eject a plurality of droplets from reservoirs in order to form a pattern, e.g., an array, on the substrate surface 51. It should be similarly evident that the device may be adapted to eject a plurality of droplets from one or more reservoirs onto the same site of the substrate surface. Furthermore, the ejection of a plurality of droplets may involve one or more ejectors. In some instances, the droplets are ejected successively from one or more reservoirs. In other instances, droplets are ejected simultaneously from different reservoirs.

Figure 2:
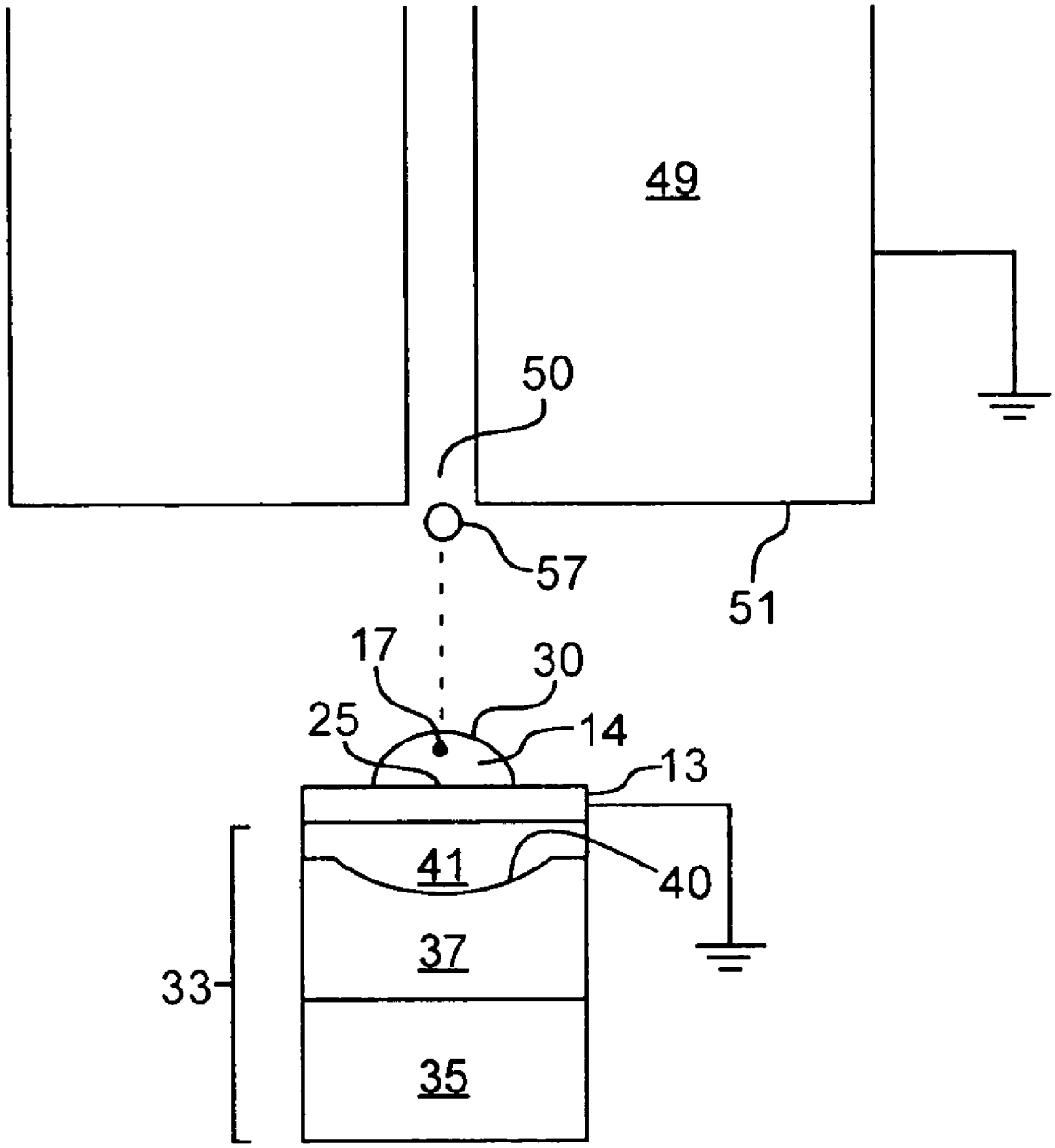
FIG. 2 illustrates in cross-sectional schematic view the ejection of droplets of fluid from a volume of fluid on a substrate surface into an inlet opening disposed on a terminus of a capillary.

As depicted in FIG. 2, the invention may be used with a single reservoir as well to improve the accuracy of droplet dispensation therefrom into an inlet opening of a sample vessel. Axially symmetric and grounded capillary 49 having an inlet opening 50 disposed on a terminus 51 thereof is provided as a sample vessel. Due to the axial symmetry of the capillary 49, the inlet opening 50 has a circular cross section. As such, the opening has a limiting dimension equal to its diameter.

A hemispherical volume of fluid 14 on a substantially flat surface 25 of a substrate 13 serves a reservoir. As shown, the substrate 13 is grounded so that it does not have any uncontrolled electrostatic charge. The shape of fluid 14 is a function of the sample wetting properties with respect to the substrate surface 25. Thus, the shape can be modified with any of a number of surface modification techniques. In addition, an ejector 33 is provided comprising an acoustic radiation generator 35 for generating radiation, and a focusing means 37 for directing the radiation at a focal point near the surface 17 of the fluid 14. The ejector 33 is shown in acoustic coupling relationship to the substrate 13 through coupling fluid 41. Proper control of acoustic wavelength and amplitude results in the ejection of a droplet 57 from the fluid 14 on the substrate 13. As the droplet 57 is shown having a diameter only slightly smaller than the diameter of the inlet opening 49, it is evident that this configuration requires strict control over the droplet size and trajectory. Thus, the substrate is 13 grounded as well.

It should be noted that although the invention is well suited for use with any fluid, the influence of the uncontrolled electrostatic charge on droplet volume and/or trajectory is particularly pronounced with ionic compounds such as charged drug moieties. In addition, the presence of uncontrolled electric fields also tends to affect polar fluids with relatively high dielectric constants (k) such as water and dimethylsulfoxide (k=80 and 48, respectively, at room temperature). As typical drug-screening compound libraries may contain compounds with varying polarities and dielectric constants, such libraries would be influenced differently by the same electrostatic charge. Thus, it should be evident that the invention is particularly suited for use in conjunction with fluidic manipulation associated with libraries.

Variations of the present invention will be apparent to those of ordinary skill in the art. For example, the invention may be suitable for use with any of the performance enhancing features associated with acoustic technologies such those described in U.S. patent application Ser. Nos. 10/010,972, and 10/310,638, each entitled "Acoustic Assessment of Fluids in a Plurality of Reservoirs," filed Dec. 4, 2001 and Dec. 4, 2002, respectively, inventors Mutz and Ellson and U.S. patent application Ser. No. 10/175,375, entitled "Acoustic Control of the Composition and/or Volume of Fluid in a Reservoir," filed Jun. 18, 2002, inventors Ellson and Mutz. In addition, the invention may be used in a number of contexts such as handling pathogenic fluids (see U.S. patent application Ser. No. 10/199,907, entitled "Acoustic Radiation of Ejecting and Monitoring Pathogenic Fluids," filed Jul. 18, 2002, inventors Mutz and Ellson) and manipulating cells and particles (see U.S. Patent Application Publication Nos. 20020090720 and 20020094582).

It is to be understood that while the invention has been described in conjunction with the preferred specific embodiments thereof, that the foregoing description and the examples that follow are intended to illustrate and not limit the scope of the invention. Other aspects, advantages, and modifications within the scope of the invention will be apparent to those skilled in the art to which the invention pertains.

All patents, patent applications, and publications mentioned herein are hereby incorporated by reference in their entireties.

The following examples are put forth so as to provide those of ordinary skill in the art with a complete disclosure and description of how to implement the invention, and are not intended to limit the scope of what the inventors regard as their invention.

EXAMPLE 1

A solution containing 70% by volume dimethylsulfoxide and 30% by volume water was placed within each well of a polystyrene well plate containing 384 substantially identical wells. An acoustic ejector having an F2 lens that served to focus acoustic radiation was placed in acoustic coupling relationship successively with each reservoir in substantially the same manner. Without removing uncontrolled electrostatic charge from the well plate, acoustic radiation having a frequency of 10 MHz was directed by the F2 lens into each reservoir so as to eject at least one droplet from each well. In some instances, secondary or satellite droplets were produced in addition to the primary droplets. The primary droplets exhibited a volume variation of over 25% as well as variations in trajectory.

EXAMPLE 2

Each well of the same polystyrene well plate described in Example 1 was again filled with a solution containing 70% by volume dimethylsulfoxide and 30% by volume water. However, uncontrolled electrostatic charge was removed from the well plate using an ionizer before the acoustic ejector was placed in acoustic coupling relationship successively with each reservoir. Acoustic radiation of having a frequency of 10 MHz was again directed by the F2 lens into each reservoir so as to eject at least one droplet from each well. No secondary or satellite droplets were produced. The primary droplets exhibited a volume variation of less than about 2%. No variations in the trajectory of the droplets were observed.

We claim:

1. A well plate comprising an array of at least 96 substantially identical wells, each well adapted to contain a fluid, wherein the well plate is comprised of a material that is at least partially nonmetallic and either has an electrical resistivity of no more than about $10^{11}$ ohm-cm, has a surface electrical resistivity of no more than about $10^{12}$ ohm/sq, or both.

2. The well plate of claim 1, wherein the well plate material is coated with an electrically conductive film.

3. The well plate of claim 2, wherein the electrically conductive film is metallic.

4. The well plate of claim 1, wherein the well plate material contains an electrically conductive filler.

5. The well plate of claim 4, wherein the electrically conductive filler is carbon.

6. The well plate of claim 1, wherein the material is at least partially polymeric.

7. The well plate of claim 6, wherein the material is entirely polymeric.

8. The well plate of claim 6, wherein the material comprises a polymer selected from the group consisting of polyethylenes, polypropylenes, polybutylenes, polystyrenes, cyclic olefins, polythiophenes, polyacetylene, derivatives thereof, combinations thereof, and copolymers of any of the foregoing.

9. The well plate of claim 1, wherein the material is comprised of an electrically conductive polymer.

10. The well plate of claim 9, wherein the well plate consists essentially of the material and the material consists essentially of an electrically conductive polymer.

* * * * *